US006457553B1

(12) United States Patent
Goplen et al.

(10) Patent No.: US 6,457,553 B1
(45) Date of Patent: Oct. 1, 2002

(54) LOW COST MUFFLER

(75) Inventors: Gary D. Goplen, Stoughton; Kory J. Schuhmacher, Oregon, both of WI (US)

(73) Assignee: Nelson Industries, Inc., Stoughton, WI (US)

( * ) Notice: Subject to any disclaimer, the term of this patent is extended or adjusted under 35 U.S.C. 154(b) by 90 days.

(21) Appl. No.: 09/632,549

(22) Filed: Aug. 4, 2000

(51) Int. Cl.[7] ..... F01N 1/08

(52) U.S. Cl. ..... 181/272; 181/212

(58) Field of Search ..... 181/272, 212, 181/213, 214, 215, 216, 227, 228, 238, 241, 249, 251, 273, 282, 264, 268

(56) References Cited

U.S. PATENT DOCUMENTS

| | | | |
|---|---|---|---|
| 2,975,854 | A | 3/1961 | Bakke et al. |
| 3,378,099 | A | 4/1968 | Gordon |
| 3,404,749 | A | 10/1968 | Miller et al. |
| 3,650,354 | A | 3/1972 | Gordon |
| 3,709,320 | A | 1/1973 | Holler et al. |

FOREIGN PATENT DOCUMENTS

| | | |
|---|---|---|
| EP | 1010868 | 6/2000 |
| FR | 1043396 | 11/1953 |

(List continued on next page.)

*Primary Examiner*—Jeffrey Donels
*Assistant Examiner*—Kim Lockett
(74) *Attorney, Agent, or Firm*—Andrus, Sceales, Starke & Sawall, LLP

(57) ABSTRACT

A muffler (20) is provided by upstream and downstream outer shells (28 and 30) and a single sole internal baffle (32 or 110 or 120), all three of which are joined to each other around an outer peripheral edge (34). The internal baffle defines a first chamber (36) between the internal baffle and the upstream outer shell. The internal baffle has an extension portion (38) extending away from the upstream outer shell and toward and into the downstream outer shell and forming second and third chambers (40 and 42) between the internal baffle and the downstream outer shell and forming multiple sound attenuating tubed passages (44 and 46, 114, 124 and 128) bounded by the downstream outer shell and the extension portion and connecting the second and third chambers on distally opposite ends (48 and 50) of the extension portion. The baffle has an opening (52) therethrough adjacent the extension portion and connecting the first and second chambers.

22 Claims, 6 Drawing Sheets

U.S. PATENT DOCUMENTS 3,863,734 A 2/1975 Pawlina
4,164,989 A 8/1979 Lux et al.
4,165,798 A 8/1979 Martinez
4,415,059 A 11/1983 Hayashi
4,700,806 A 10/1987 Harwood
4,736,817 A 4/1988 Harwood
4,741,411 A 5/1988 Stricker
4,759,423 A 7/1988 Harwood et al.
4,765,437 A 8/1988 Harwood et al.
4,766,983 A 8/1988 Tamba et al.
4,809,812 A 3/1989 Flugger
4,821,840 A 4/1989 Harwood et al.
4,836,330 A 6/1989 Harwood et al.
4,847,965 A 7/1989 Harwood et al.
4,860,853 A 8/1989 Moring, III
4,865,154 A 9/1989 Hanson et al.
4,894,987 A 1/1990 Harwood et al.
4,901,815 A 2/1990 Harwood et al.
4,909,348 A 3/1990 Harwood et al.
4,924,968 A 5/1990 Moring, III et al.
4,928,372 A 5/1990 Harwood et al.
4,941,545 A 7/1990 Wilcox et al.
4,958,701 A 9/1990 Moring, III
4,972,921 A 11/1990 Takada et al.
5,004,069 A 4/1991 Van Blaircum et al.
5,042,125 A 8/1991 Harwood et al.
5,147,987 A 9/1992 Richardson et al.
5,164,551 A 11/1992 Harwood et al.
5,173,577 A 12/1992 Clegg et al.
5,229,557 A 7/1993 Allman et al.
5,252,788 A 10/1993 Emrick et al.
5,315,075 A 5/1994 Junginger et al.
5,326,943 A 7/1994 Macaulay
5,327,722 A 7/1994 Clegg et al.
5,428,194 A 6/1995 Emrick et al.
5,448,831 A 9/1995 Harwood
5,473,891 A 12/1995 Baxter et al.
5,504,280 A 4/1996 Woods
5,563,383 A 10/1996 Harwood
5,563,385 A 10/1996 Harwood
5,581,056 A 12/1996 Bellgardt et al.
5,597,986 A 1/1997 Harwood et al.
5,614,699 A * 3/1997 Yashiro et al. ..... 181/254
5,717,173 A 2/1998 Gerber et al.
5,732,555 A 3/1998 Gracyalny et al.
5,773,770 A 6/1998 Jones
5,859,394 A 1/1999 Stehaus et al.
6,076,632 A 6/2000 Schuhmacher et al.
6,164,412 A * 12/2000 Allman ..... 181/272
6,173,808 B1 * 1/2001 Maeda et al. ..... 181/254
6,257,367 B1 * 7/2001 Allman ..... 181/282
6,332,510 B1 * 12/2001 Frederiksen ..... 181/256

* cited by examiner

FIG. 12
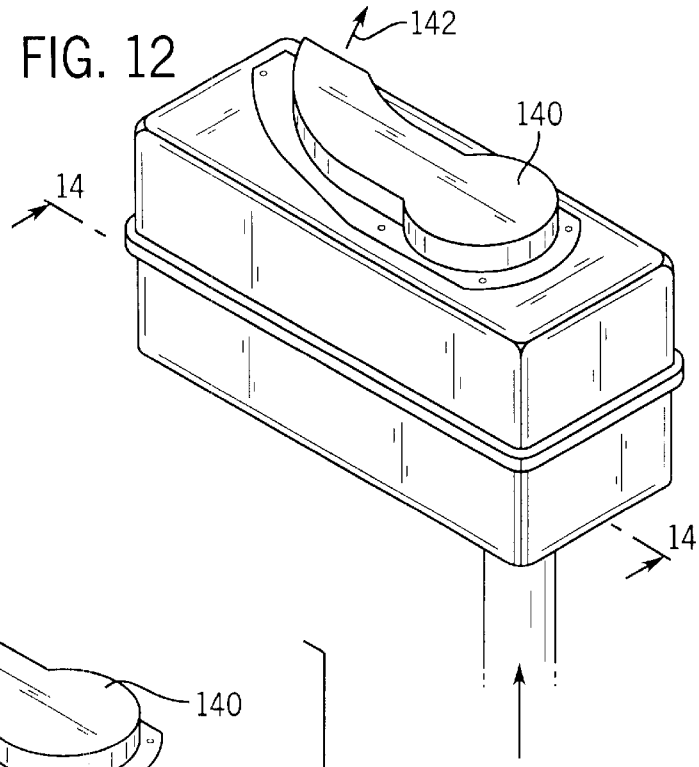
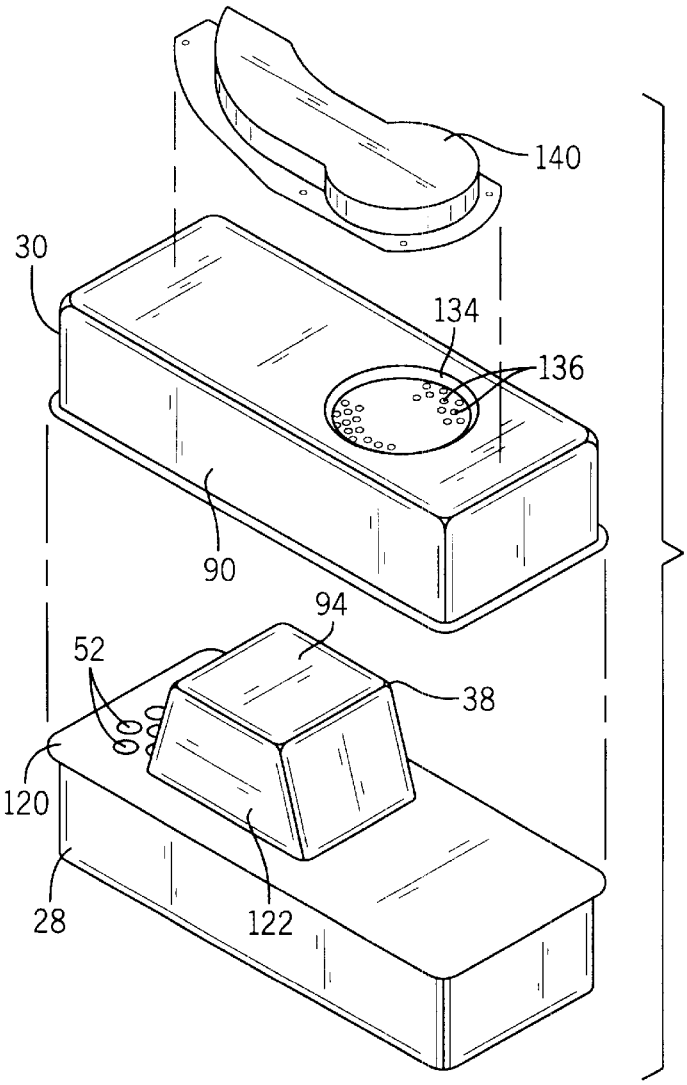
FIG. 13

LOW COST MUFFLER

BACKGROUND AND SUMMARY

The invention relates to noise-silencing mufflers.

The invention arose during continuing muffler development efforts, including further development efforts directed toward cost reduction.

Stamped mufflers are known in the art, and typically use multiple internal baffles and tubes to silence exhaust noise. Increased part content increases cost. Tubes are desirable for silencing low and mid frequencies, however they are expensive and increase part content.

The present invention reduces cost by minimizing part content. The construction of the present invention enables multiple chambers and multiple tubes all formed by a single sole internal baffle, reducing cost without sacrificing noise attenuation. In the preferred embodiment, an upstream outer shell, a downstream outer shell and a single sole internal baffle are the only components joined at their outer peripheral edge, and provide a muffler with three chambers and multiple sound attenuating tubed passages.

BRIEF DESCRIPTION OF THE DRAWINGS

FIG. 12 is a view like FIG. 1 but showing an alternate embodiment.

FIG. 13 is an exploded perspective view of the structure of FIG. 12.

DETAILED DESCRIPTION

Figure 1:
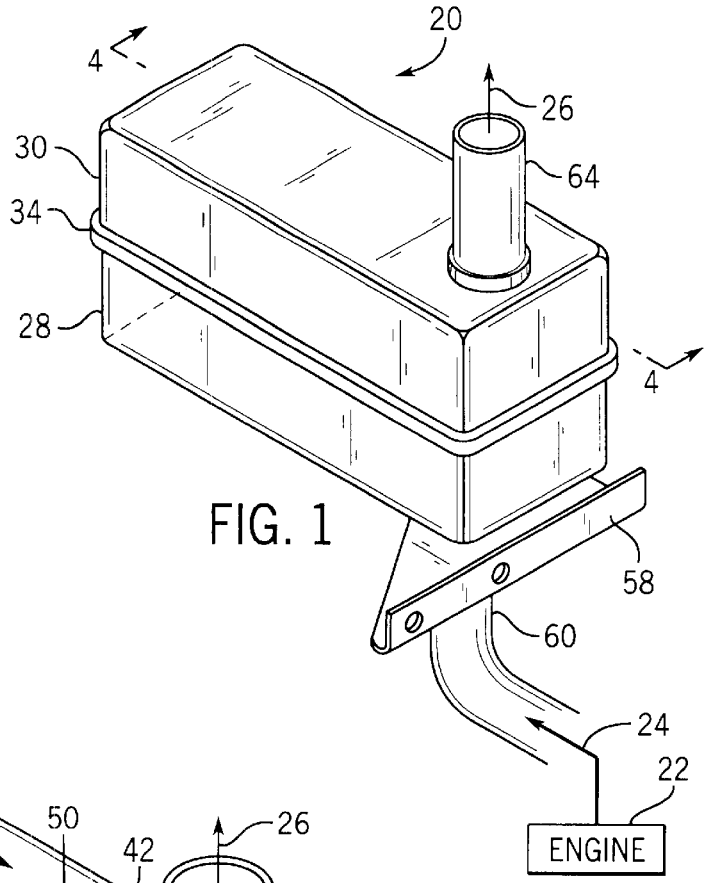
FIG. 1 is an isometric elevational view of a muffler constructed in accordance with the invention.
Figure 3:
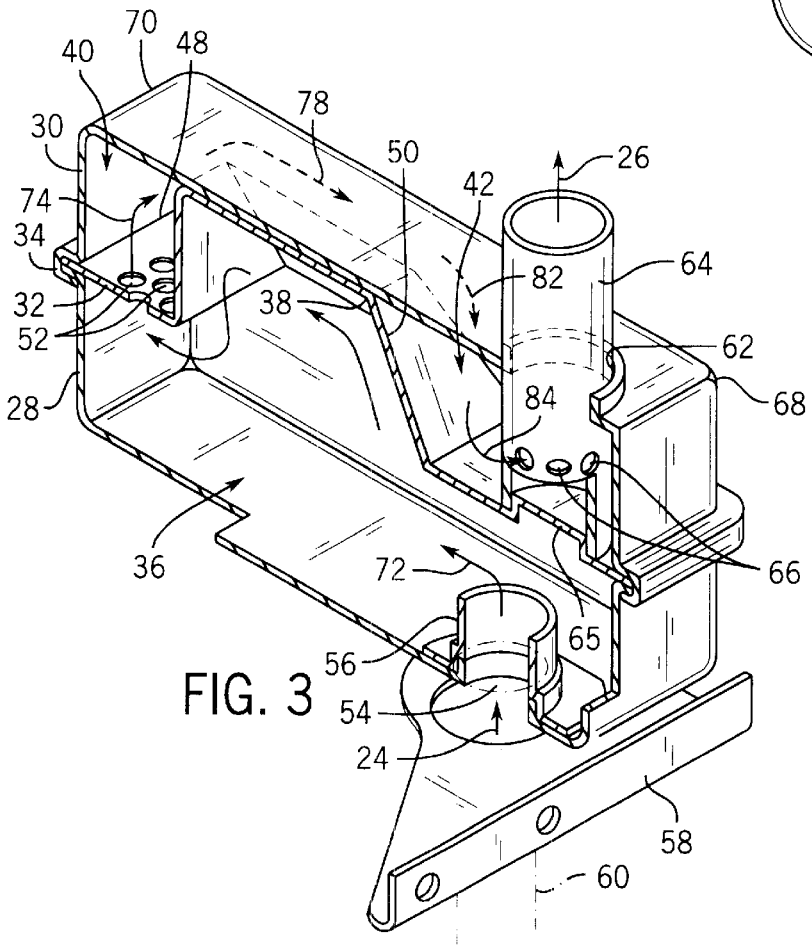
FIG. 3 is a view like FIG. 1, partially cut away.
Figure 2:
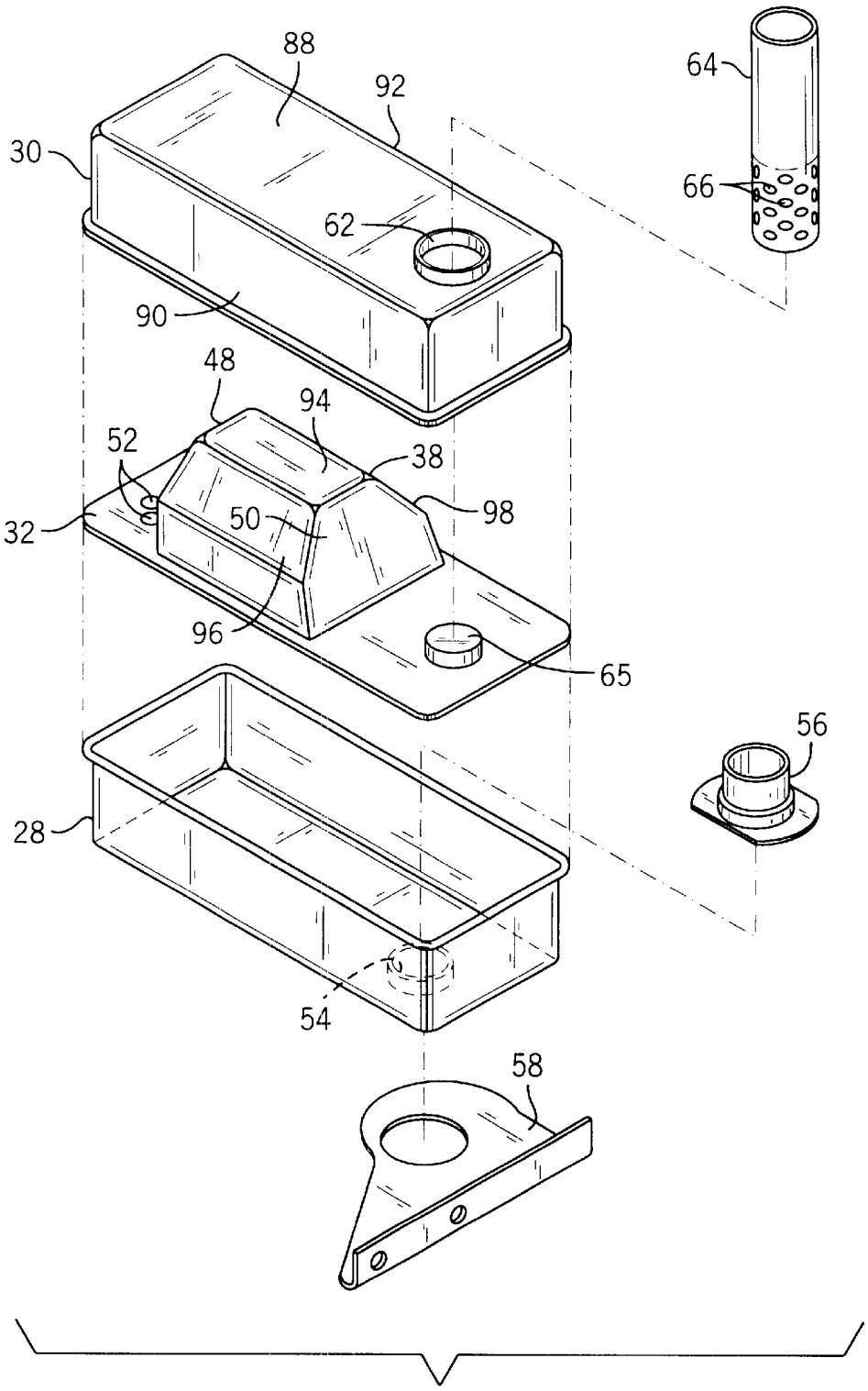
FIG. 2 is an exploded perspective view of the structure of FIG. 1.
Figure 4:
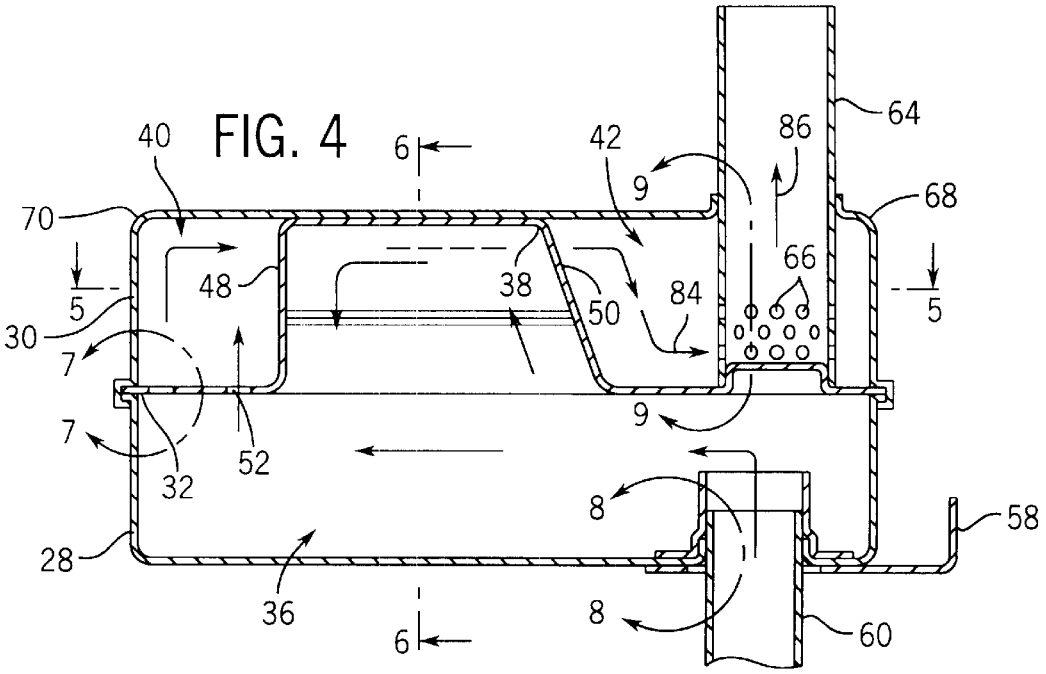
FIG. 4 is a sectional view taken along line 4—4 of FIG. 1.

FIGS. 1–3 show a muffler 20 receiving exhaust from internal combustion engine 22 as shown at arrow 24, which exhaust exits the muffler as shown at arrow 26. The muffler is formed by a first or upstream outer shell 28, a second or downstream outer shell 30, and a single sole internal baffle 32, all three of which are joined to each other around an outer peripheral edge 34, such as by crimping one of the members such as shell 30 around the other members, FIG. 7, or by welding, adhesive bonding, or the like. Internal baffle 32 defines a first chamber 36, FIGS. 3, 4, between baffle 32 and upstream outer shell 28. Baffle 32 has an extension portion 38, FIG. 2, extending away from upstream outer shell 28 and toward and into downstream outer shell 30 and forming second and third chambers 40 and 42 between baffle 32 and downstream outer shell 30. Extension portion 38 of baffle 32 also forms at least one and preferably multiple sound attenuating tubed passages 44, 46, FIG. 6, bounded by outer shell 30 and extension portion 38 and connecting second and third chambers 40 and 42 on distally opposite ends 48 and 50 of extension portion 38. Passages 44 and 46 are formed between outer shell 30 and extension portion 38 without the use of separate tubes. Baffle 32 has an opening 52 therethrough, preferably provided by a plurality of perforations, adjacent extension portion 38 and connecting first and second chambers 36 and 40.

Figure 8:
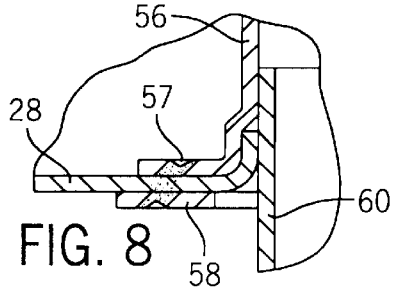
FIG. 8 is an enlarged view of another portion of FIG. 4.
Figure 9:
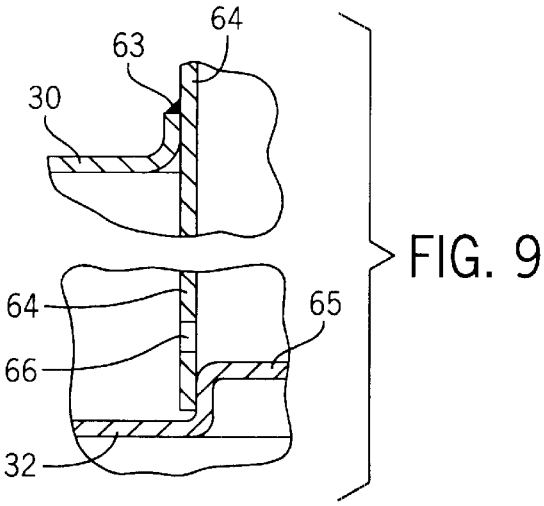
FIG. 9 is an enlarged view of further portions of FIG. 4.

The muffler has an inlet 54, FIG. 2, through upstream outer shell 28, preferably provided by a flanged tube 56 around the aperture at 54 in shell 28, providing rigid backing for attachment to engine bracket 58 through which engine exhaust pipe 60 extends. The muffler has an outlet 62, FIG. 2, provided by an aperture through downstream outer shell 30 receiving exhaust tube 64 therein which has a plurality of inner perforations 66 receiving exhaust flow therethrough. Flanged tube 56, outlet 54 of shell 28, and bracket 58 are preferably rigidly attached to each other for added strength, such as by welding, as shown at weldments 57, FIG. 8, or crimping, adhesive bonding, or the like. Outlet tube 64 is preferably rigidly attached to shell 30 at outlet opening 62, by welding as shown at weldment 63, FIG. 9, or crimping, adhesive bonding, or the like. The inner end of tube 64 is located by raised alignment cylindrical nub 65 on baffle 32.

Figure 5:
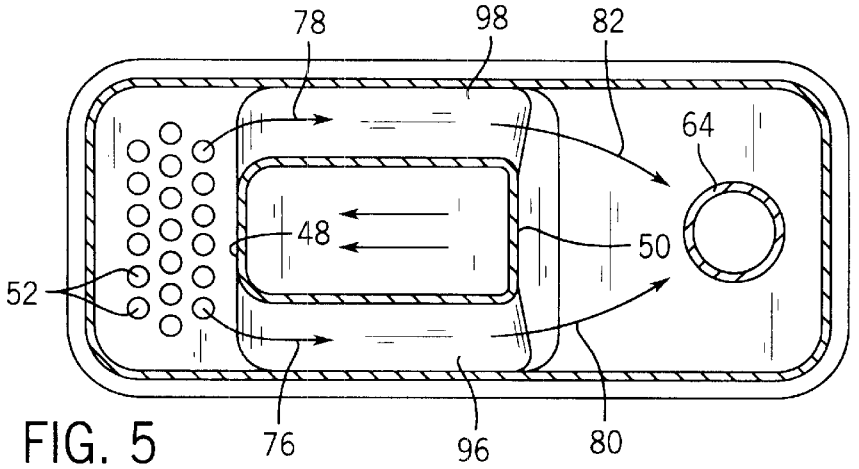
FIG. 5 is a sectional view taken along line 5—5 of FIG. 4.

Extension portion 38 of baffle 32 extends away from outer shell 28 and toward and into outer shell 30 and expands the volume of first chamber 36 at the expense of second and third chambers 40 and 42. The volume of first chamber 36 is substantially greater than the combined volume of second and third chambers 40 and 42. Muffler 20 has first and second distally opposite ends 68 and 70, FIG. 3, spaced by extension portion 38 therebetween. Inlet 54, outlet 62, and third chamber 42 are at first end 68. Second chamber 40 and perforation openings 52 through baffle 32 are at second end 70. First chamber 36 spans both of the first and second ends 68 and 70. Exhaust flows through inlet 54 as shown at arrow 24, FIG. 3, into the muffler at first end 68 and then traverses as shown at arrow 72 through first chamber 36 to second end 70 and then passes through perforation openings 52 in baffle 32 as shown at arrow 74 into second chamber 40 and then traverses back to the first end through sound attenuating tubed passages 44, 46 as shown at respective arrows 76, 78, FIG. 5, and into and through third chamber 42 as shown at arrows 80, 82 and then flows through perforations 66 as shown at arrow 84, FIGS. 3, 4, then through outlet tube 64 as shown at arrow 86, FIG. 4, then through outlet 62 as shown at arrow 26, FIG. 3.

Figure 6:
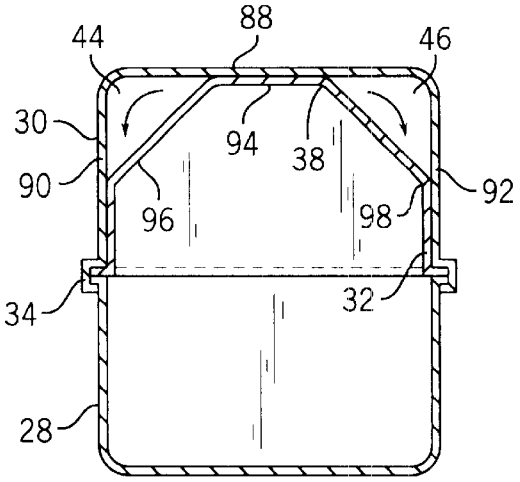
FIG. 6 is a sectional view taken along line 6—6 of FIG. 4.
Figure 7:
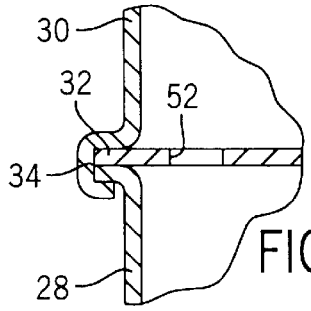
FIG. 7 is an enlarged view of a portion of FIG. 4.

Outer shell 30 has an outer wall 88, FIG. 6, and first and second sidewalls 90 and 92 depending therefrom and extending toward and mating with baffle 32 and outer shell 28 at outer peripheral edge 34. Extension portion 38 of baffle 32 has an extended wall 94, FIGS. 2, 6, facing and preferably adjacent or engaging outer wall 88 and having first and second sidewalls 96 and 98 depending from extended wall 94. Sidewalls 96 and 98 extend left to right in FIGS. 2 and 5 between first and second, left and right, distally opposite ends 48 and 50 of extension portion 38. First or left end 48 of extension portion 38 faces second chamber 40. Second or right end 50 of extension portion 38 faces third chamber 42. Sidewall 96 of extension portion 38 is sloped and tapered away from outer wall 88 and first sidewall 90 of outer shell 30 to define sound attenuating tubed passage 44. Passage 44 extends from first end 48 of extension portion 38 to second end 50 of extension portion 38. Second sidewall 98 of extension portion 38 is sloped and tapered away from outer wall 88 and second sidewall 92 of outer shell 30 to define sound attenuating tubed passage 46. Passage 46 extends from first end 48 to second end 50 of extension portion 38. Passages 44 and 46 extend in parallel between second and third chambers 40 and 42.

Figure 11:
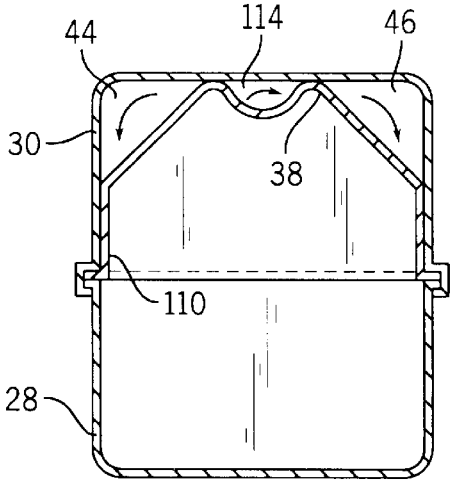
FIG. 11 is a sectional view like FIG. 6 but showing the flow for the embodiment of FIG. 10.
Figure 10:
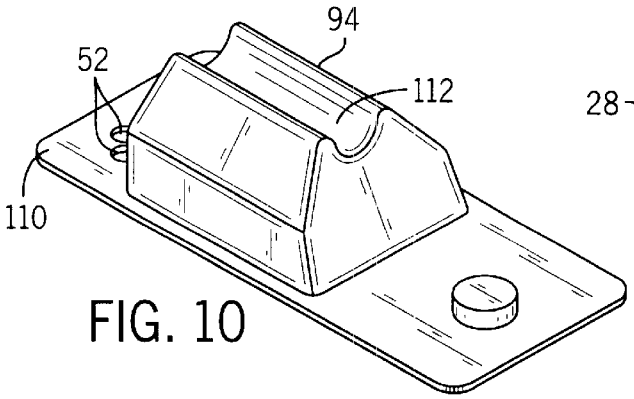
FIG. 10 is a view like a portion of FIG. 2 but showing an alternate embodiment.

FIG. 10 shows an alternate embodiment of baffle 32 of FIG. 2 and uses like reference numerals from above where appropriate to facilitate understanding. In FIG. 10, extended wall 94 of extension portion 38 of baffle 110 has a concave section 112 recessed away from outer wall 88 of outer shell 30 to define a third sound attenuating tubed passage 114, FIG. 11. Passage 114 extends from first end 48 to second end 50 of extension portion 38. First, second and third sound attenuating tubed passages 44, 46 and 114 extend in parallel between second and third chambers 40 and 42. Third passage 114 is between first and second passages 44 and 46.

Figure 14:
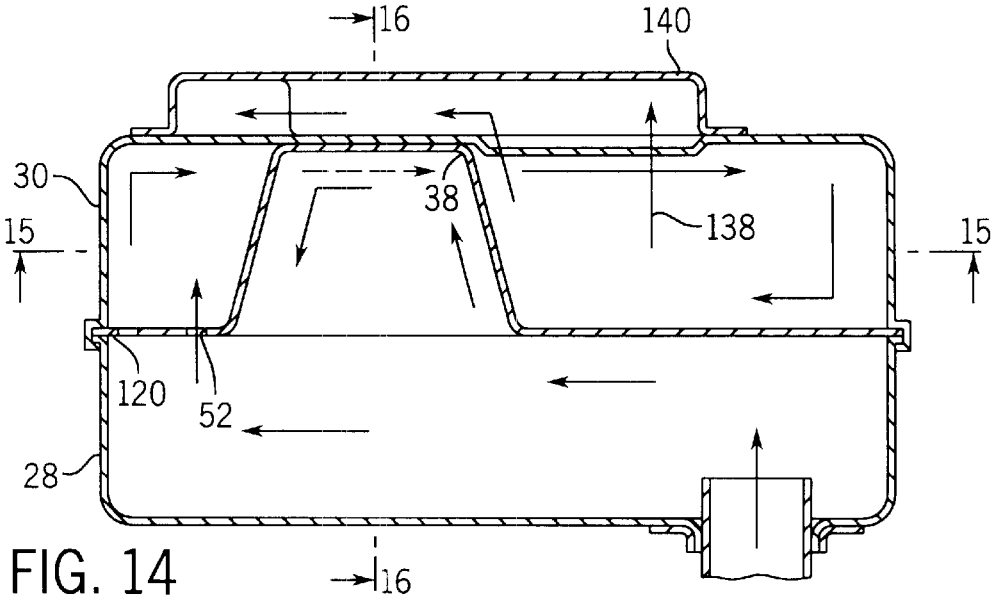
FIG. 14 is a sectional view taken along line 14—14 of FIG. 12.
Figure 15:
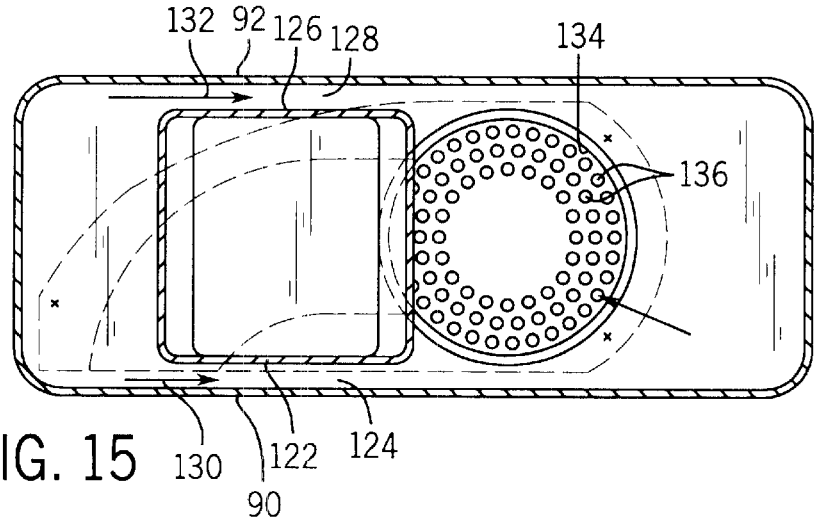
FIG. 15 is a sectional view taken along line 15—15 of FIG. 14.
Figure 16:
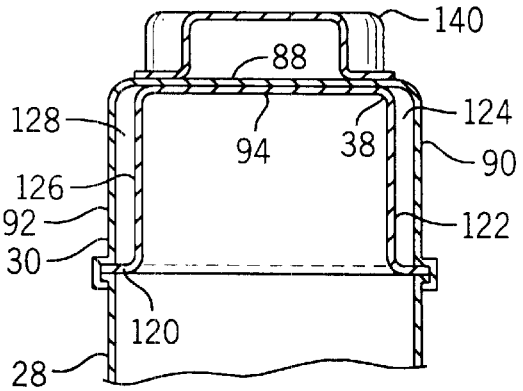
FIG. 16 is a sectional view taken along line 16—16 of FIG. 14.

FIG. 13 shows another alternate baffle 120 and uses like reference numerals from above where appropriate to facilitate understanding. In FIG. 14, at least a portion of and preferably the entire first sidewall 122 of extension portion 38 is spaced from first sidewall 90 of outer shell 30 to define a first sound attenuating tubed passage 124, FIGS. 15 and 16. At least a portion of and preferably the entire second sidewall 126 of extension portion 38 of baffle 120 is spaced from second sidewall 92 of outer shell 30 to define a second sound attenuating tubed passage 128. Passages 124 and 128 extend parallel to each other between first and second chambers 40 and 42 and provide flow therethrough from left to right in FIG. 15 as shown at respective arrows 130 and 132.

FIG. 13 also shows an alternate outlet 134 from outer shell 30, namely a plurality of perforations 136 through which exhaust flows upwardly as shown at arrow 138 in FIG. 14 into top exit shroud 140 for discharge as shown at arrow 142 in FIG. 12.

The disclosed constructions provide reduced part content and cost. The upstream and downstream outer shells 28 and 30 and the single sole internal baffle 32 or 110 or 120 are the only members joined at outer peripheral edge 34, reducing part content and cost. The construction provides in preferred form at least two sound attenuating tubed passages 44, 46, and optionally 114, or 124 and 128, which sound attenuating tubed passages are formed between the downstream outer shell 30 and the extension portion 38 of the single sole internal baffle, such that multiple sound attenuating tubed passages are formed by a single sole internal baffle, further reducing cost.

It is recognized that various equivalents, alternatives and modifications are possible within the scope of the appended claims.

What is claimed is:

1. A muffler comprising first and second outer shells, and an internal baffle, all three of which are joined to each other around an outer peripheral edge, said internal baffle defining a first chamber between said internal baffle and said first outer shell, said internal baffle having an extension portion extending away from said first outer shell and toward and into said second outer shell and forming second and third chambers between said internal baffle and said second outer shell and forming at least one sound attenuating tubed passage bounded by said second outer shell and said extension portion and connecting said second and third chambers on distally opposite ends of said extension portion, said internal baffle having an opening therethrough adjacent said extension portion and connecting said first and second chambers.

2. The invention according to claim 1 wherein said muffler has an inlet through said first outer shell, an outlet through said second outer shell, and wherein said extension portion of said internal baffle extending away from said first outer shell and toward and into said second outer shell expands the volume of said first chamber at the expense of said second and third chambers.

3. The invention according to claim 2 wherein the volume of said first chamber is substantially greater than the combined volume of said second and third chambers.

4. The invention according to claim 2 wherein said muffler has first and second distally opposite ends spaced by said extension portion therebetween, wherein said inlet, said outlet, and said third chamber are at said first end, said second chamber and said opening through said internal baffle are at said second end, and said first chamber spans both said first and second ends, such that exhaust flows through said inlet into said muffler at said first end then traverses to said second end through said first chamber and then passes through said opening in said internal baffle into said second chamber and then traverses back to said first end through said at least one sound attenuating tubed passage and through said third chamber and then flows out through said outlet.

5. The invention according to claim 4 wherein said second outer shell has an outer wall and first and second sidewalls depending therefrom and extending toward and mating with said internal baffle and said first outer shell at said outer peripheral edge, and wherein said extension portion of said internal baffle has an extended wall facing said outer wall of said second outer shell and having first and second sidewalls depending therefrom and extending between first and second said distally opposite ends of said extension portion, said first end of said extension portion facing said second chamber, said second end of said extension portion facing said third chamber, said first sidewall of said extension portion being sloped and tapered away from at least one of said outer wall of said second outer shell and said first sidewall of said second outer shell to define a first said sound attenuating tubed passage, said first sound attenuating tubed passage extending from said first end of said extension portion to said second end of said extension portion, said second sidewall of said extension portion being sloped and tapered away from at least one of said outer wall of said second outer shell and said second sidewall of said second outer shell to define a second said sound attenuating tubed passage, said second sound attenuating tubed passage extending from said first end of said extension portion to said second end of said extension portion.

6. The invention according to claim 5 wherein said first and second sound attenuating tubed passages extend in parallel between said second and third chambers.

7. The invention according to claim 5 wherein said first sidewall of said extension portion is sloped and tapered away from each of said outer wall of said second outer shell and said first sidewall of said second outer shell, and said second sidewall of said extension portion is sloped and tapered away from each of said outer wall of said second outer shell and said second sidewall of said second outer shell.

8. The invention according to claim 5 wherein said extended wall of said extension portion of said internal baffle has a concave section recessed away from said outer wall of said second outer shell to define a third said sound attenuating tubed passage, said third sound attenuating tubed passage extending from said first end of said extension portion to said second end of said extension portion.

9. The invention according to claim 8 wherein said first, second and third sound attenuating tubed passages extend in parallel between said second and third chambers, said third sound attenuating tubed passage being between said first and second sound attenuating tubed passages.

10. The invention according to claim 4 wherein said second outer shell has an outer wall and first and second sidewalls depending therefrom and extending toward and mating with said internal baffle and said first outer shell at said outer peripheral edge, and wherein said extension portion of said internal baffle has an extended wall facing said outer wall of said second outer shell and having first and second sidewalls depending therefrom and extending between first and second said distally opposite ends of said extension portion, said first end of said extension portion facing said second chamber, said second end of said extension portion facing said third chamber, said extended wall of said extension portion having a concave section recessed away from said outer wall of said second outer shell to define said sound attenuating tubed passage, said sound attenuating tubed passage extending from said first end of said extension portion to said second end of said extension portion.

11. The invention according to claim 4 wherein said second outer shell has an outer wall and first and second sidewalls depending therefrom and extending toward and mating with said internal baffle and said first outer shell at said outer peripheral edge, and wherein said extension portion of said internal baffle has an extended wall facing said outer wall of said second outer shell and having first and second sidewalls depending therefrom and extending between first and second said distally opposite ends of said extension portion, said first end of said extension portion facing said second chamber, said second end of said extension portion facing said third chamber, at least a portion of said first sidewall of said extension portion being spaced from said first sidewall of said second outer shell to define a first said sound attenuating tubed passage, at least a portion of said second sidewall of said extension portion being spaced from said second sidewall of said second outer shell to define a second said sound attenuating tubed passage.

12. The invention according to claim 11 wherein said first and second sound attenuating tubed passages extend in parallel between said second and third chambers.

13. The invention according to claim 11 wherein the entire said first sidewall of said extension portion is spaced from said first sidewall of said second outer shell, and wherein the entire said second sidewall of said extension portion is spaced from said second sidewall of said second outer shell.

14. A muffler comprising an upstream outer shell, a downstream outer shell, and a single sole internal baffle, all three of which are joined to each other around an outer peripheral edge, said single sole internal baffle defining a first chamber between said single sole internal baffle and said upstream outer shell, said internal baffle having an extension portion extending away from said upstream outer shell and toward and into said downstream outer shell and forming second and third chambers between said single sole internal baffle and said downstream outer shell and at least one sound attenuating tubed passage between said downstream outer shell and said extension portion and connecting said second and third chambers on distally opposite ends of said extension portion, said single sole internal baffle having an opening therethrough adjacent said extension portion and connecting said first and second chambers, an inlet through said upstream outer shell, an outlet through said downstream outer shell, said extension portion of said single sole internal baffle expanding the volume of said first chamber at the expense of the volume of said second and third chambers.

15. The invention according to claim 14 wherein the volume of said first chamber is substantially greater than the combined volume of said second and third chambers.

16. The invention according to claim 14 wherein said upstream and downstream outer shells and said single sole internal baffle are the only members joined at said outer peripheral edge, reducing part content and cost.

17. The invention according to claim 16 comprising at least two said sound attenuating tubed passages between said downstream outer shell and said extension portion, such that multiple sound attenuating tubed passages are formed by said single sole internal baffle, further reducing cost.

18. The invention according to claim 14 wherein said muffler has first and second distally opposite ends spaced by said extension portion therebetween, wherein said inlet, said outlet and said third chamber are at said first end, said second chamber and said opening through said single sole internal baffle are at said second end, and said first chamber spans both said first and second ends, such that exhaust flows through said inlet into said muffler at said first end then traverses to said second end through said first chamber and then passes into said second chamber through said opening in said single sole internal baffle and then traverses back to said first end through said sound attenuating tubed passage and through said third chamber and then flows out through said outlet.

19. The invention according to claim 14 wherein said opening in said single sole internal baffle comprises a plurality of perforations.

20. The invention according to claim 14 wherein said inlet comprises a tube extending through an opening in said upstream outer shell.

21. The invention according to claim 14 wherein said outlet comprises a tube extending through an opening in said downstream outer shell.

22. The invention according to claim 14 wherein said outlet comprises a plurality of perforations in said downstream outer shell.

* * * * *